United States Patent [19]

Pasmannik et al.

[11] 4,429,255

[45] Jan. 31, 1984

[54] KLYSTRON

[76] Inventors: Vitaly I. Pasmannik, ulitsa Ostrovityanova, 45, korpus 1, kv. 569; Ljudmila A. Mironenko, prospekt Vernadskogo, 67, kv. 45; Sergei N. Nazarov, ulitsa Dnepropetrovskaya, 23, korpus 3, kv. 47, all of Moscow, U.S.S.R.

[21] Appl. No.: 270,515

[22] PCT Filed: Nov. 28, 1979

[86] PCT No.: PCT/SU79/00121

§ 371 Date: Jun. 1, 1981

§ 102(e) Date: Jun. 1, 1981

[87] PCT Pub. No.: WO81/01628

PCT Pub. Date: Jun. 11, 1981

[51] Int. Cl.[3] ..... H01J 25/10

[52] U.S. Cl. ..... 315/5.39; 313/46; 315/5.23; 333/234

[58] Field of Search ..... 313/46; 315/5.39, 5.23; 333/229, 234

[56] References Cited

U.S. PATENT DOCUMENTS

| | | | |
|---|---|---|---|
| 2,606,302 | 8/1952 | Learned | 333/229 X |
| 2,880,357 | 3/1959 | Snow et al. | 315/5.23 |
| 2,892,121 | 6/1959 | Salisbury | 315/5.39 |
| 3,222,565 | 12/1965 | Oaks | 333/234 X |
| 3,573,680 | 4/1971 | Carignan | 333/229 |
| 3,678,327 | 7/1972 | Schmidt | 315/5.39 |

*Primary Examiner*—Saxfield Chatmon, Jr.
*Attorney, Agent, or Firm*—Burton L. Lilling; Myron Greenspan; Bruce E. Lilling

[57] ABSTRACT

The klystron of the invention comprises cavities 5 with face walls 7 and drift tubes 8. There are annular slots 9in the face walls 7 and drift tubes 8, said annular slots 9 accommodating plates 10 rigidly attached thereto, said plates 10 being made of a nonmagnetic material. The height of the plates 10 is less than half the height of the body 6 of the cavity 5. The length of the plates 10 is equal to the half-difference between the inner diameter of the body 6 and the inner diameter of the drift tube 8. The length of the inner circumference of the body 6 is more than ten times the total thickness of the plates 10.

The klystron of the invention can be used in radioelectronic units to provide for higher stability of their output characteristics.

2 Claims, 3 Drawing Figures

KLYSTRON

TECHNICAL FIELD

The invention relates to microwave devices, and more particularly to the construction of klystrons.

BACKGROUND ART

In order to improve the stability of klystron output characteristics, it is necessary to resist deformations that may affect klystron cavities due to temperature effects.

The background art deals with many constructional implementations of klystron resonant cavities.

Known in the art is a klystron utilizing its cavity assemblies made of oxygen-free copper. Each cavity comprises a body and face walls accommodating drift tubes. In the case of an average-power klystron, heat is applied to the cavities due to the following effects: microwave power loss that occurs in the cavity walls; and partial interception of the electron beam by the drift tubes (cf. U.S. Pat. No. 1,491,421, cl.21g, 13/17, 1963).

Heating the cavities may lead to burning of the ends of the drift tubes, to deformations of the walls, and to a change in the resonant frequencies of the cavities.

To resist the heating, use is made of forced cooling, liquid or air.

There is another kylstron comprising cavities with face walls, which accommodate drift tubes (cf. the USSR Inventor's Certificate No. 266,791, cl. HOlJ 23/20, 1972). In this klystron, higher stability of the output characteristics is attained in the following manner. The portions of the drift tubes in the cavities are provided with an annular slot which is positioned concentrically with the klystron axis, beginning at the end of the drift tube and terminating in the cooled elements of the cavities.

The outer portion of the drift tube is made of a material having a low linear expansion coefficient, for example, molybdenum.

Though the drift tubes are bimetallic, the face walls are yet of considerable thickness. The difference between the linear expansion coefficients of the dissimilar metals causes an extra mechanical stress in the cavity walls. The annular slot causes an increase in the area of the capacitive gap of the cavity, which results in a decrease of its wave resistance, thereby impairing the output characteristics of the klystron. With a klystron having a high power output, there may result a parasitic oscillation since the annular slot approaches a resonance condition in this case.

DISCLOSURE OF THE INVENTION

The invention therefore seeks to attain a klystron of such a construction which provides for more robust cavities with stable operating characteristics, the constructional features of the cavities are so selected that an optimum structure of the magnetic field of the focusing system of the klystron is obtained.

There is provided a klystron comprising cavities with face walls in which drift tubes are accommodated in a coaxial relation to the cavity body, there are, according to the invention, annular slots in the face walls of the cavities and in the drift tubes, said annular slots accommodating plates rigidly attached thereto, the height of the plates being less than half the height of the cavity body, the length of the plates being the half-difference between the inner diameter of the cavity body and the inner diameter of the drift tube, and the length of the inner circumference of the cavity body being more than ten times the total thickness of the plates.

The plates provide for higher stiffness of the face walls and drift tubes of the cavities, with the result that their deformations due to temperature effect decrease and the output characteristics of the klystron are improved.

Preferably, the plates should be made of a nonmagnetic material, thereby eliminating a distortion of the magnetic field of the focusing system of the klystron.

PREFERRED MODE OF THE INVENTION

Figure 1:
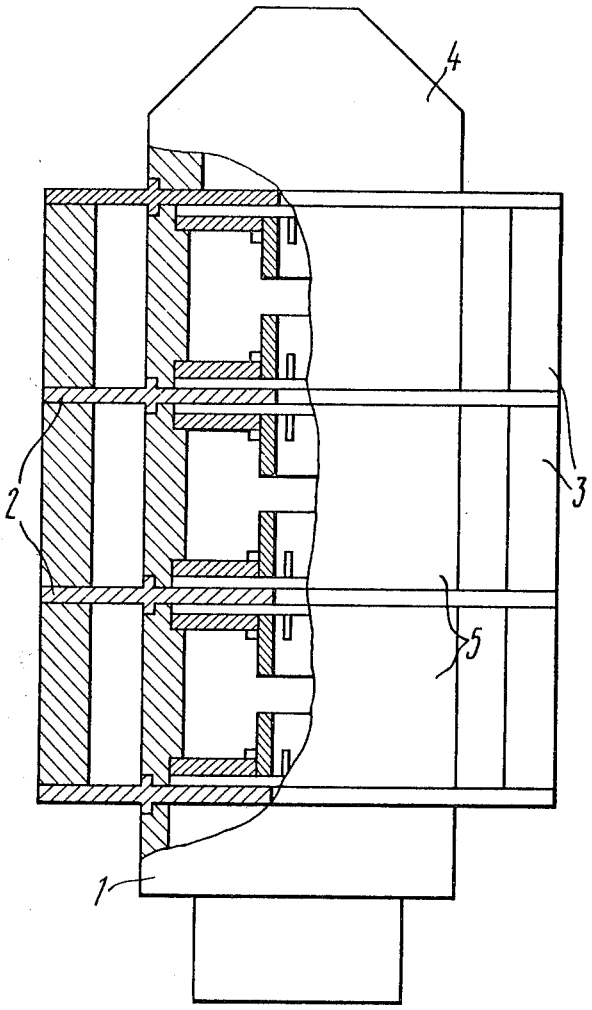
FIG. 1 is a general view of a klystron, according to the invention.
Figure 2:
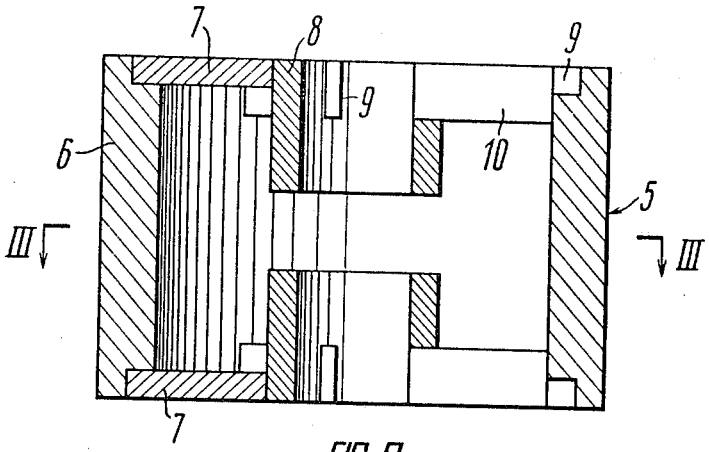
FIG. 2 shows a construction of a cavity of the klystron, according to the invention.
Figure 3:
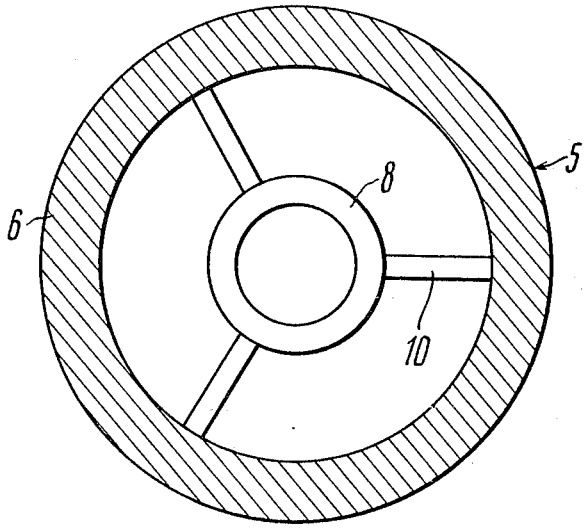
FIG. 3 is a sectional view along the line III—III of FIG. 2.

Referring to FIG. 1, the klystron comprises, according to the invention, an electron gun 1 mounted in front of a focusing system including magnetic flanges 2 which carry magnets 3. The last flange 2 mounts a collector 4 and cavities 5 are installed between the adjacent flanges 2. Each cavity 5 comprises a body 6 (FIGS. 2, 3) having face walls 7 which accommodate drift tubes 8 arranged in a coaxial relation to the body 6. There are annular slots 9 cut by milling in the face walls 7 and drift tubes 8 and spaced by equal intervals circumferentially. Brazed into the annular slots 9 are plates 10, which are made of a stainless steel having no ferromagnetic properties. Since the face walls 7 and drift tubes 8 are made of oxygen-free copper, the plates 10 are nickel-plated, which ensures reliable brazing connection between these plates and the elements made of oxygen-free copper.

The klystron of the invention operates in the following manner. An electron beam produced by the electron gun 1 is focused by means of the magnetic flanges 2 and magnets 3, passes through the drift tubes 8 (FIGS. 2, 3) of the cavities 5 and is intercepted by the collector 4 (FIG. 1). Some part of the electron beam may be intercepted by the inner surface of the drift tubes 8 (FIGS. 2, 3) and cause their local heating. The resulting temperature difference between the body 6 and drift tubes 8 leads to the occurrence of mechanical stress in the face walls 7. The plates 10 have, however, their elastic limit several ten times that of the annealed copper. This protects the face walls 7 from a deformation at which a departure of the resonant frequency of the cavity 5 is likely to occur.

There may be situations in which a considerable part of the electron beam is intercepted by the drift tubes 8 and the thickness of the face wall 7 is less than 0.1 of the inner diameter of the body of the cavity 5. Under these circumferences, in order to provide for higher integrity of the joint between the face wall 7 and the drift tube 8, it is necessary to keep at a maximum the length of the plate 10 equal to the half-difference between the inner diameter of the body 6 of the cavity 5 and the inner diameter of the drift tube 8.

When the interception of the electrons by the drift tubes 8 is at a moderate level during the dynamic mode of operation of the klystron and the drift tubes possess a good stiffness, it is common practice to have the length of the plate 10 equal to the half-difference between the inner diameter of the body 6 and the outer diameter of the drift tube 8.

Thus the length of the plate 10 is in the range $$L=\tfrac{1}{2}(D-D_1) \text{ to } \tfrac{1}{2}(D-D_2)$$

where D is the inner diameter of the body 6, $D_1$ is the inner diameter of the drift tube 8, and $D_2$ is the outer diameter of the drift tube 8.

With the thickness of the face wall 7 exceeding 0.1 of the inner diameter of the body 6, a condition is satisfactory in which a minimum height of the plates 10 is equal to the thickness of the face wall 7. In this condition, the volume of the cavity 5 is kept constant and the stability of the shape of the face wall 7 is good since the elastic limit of the steel plates 10 considerably exceeds that of the annealed copper.

When the thickness of the face wall 7 is lower than 0.1 of the inner diameter of the body 6, the height of the plates 10 may exceed the thickness of the face walls 7, but should not exceed the height of the drift tube 8, otherwise an extra capacitance produced by the plate 10 will cause an increase in the capacitance of the cavity 5, the characteristic impedance of the klystron will decrease and the klystron parameters will be impaired.

Thus the height of the plate 10 is in the range $$H_1 \leqq H < H_2$$

where $H_1$ is the thickness of the face wall 7, H is the height of the plate 10, and $H_2$ is the height of the drift tube 8.

The thickness of the plate 10 is selected so that the following conditions are satisfied: neither the plate itself nor the face wall 7 undergo deformation in heating; and the frequency characteristics of the cavity 5 are kept optimum. To provide for simpler method of fabrication of the face walls 7 and drift tubes 8, it is good practice to use plates 10 equal in number to four as a maximum. If this is not so, the characteristics of the cavity 5 will be impaired due to a change in the capacitance of the cavity 5. The total thickness of the plates 10 should not exceed the inner length of the circumference of the drift tube 8

$$n\Delta < \pi D_1$$

where n is the number of the plates 10, Δ is the thickness of the plate 10, and $D_1$ is the inner diameter of the drift tube 8.

Owing to the fact that the plates 10 are available in the face walls 7 of the cavities 5, the klystron of the invention offers stable operation and its output characteristics are good. The experimental results show that in the absence of the plates 10 there occurs a variation of the output characteristics of the klystron.

In the klystron of the invention, the face walls retain their shape and the characteristics of the cavities such as the frequency, characteristics impedance and Q-factor are kept optimum.

Industrial Applicability

The klystron of the invention can be used in the field of electronics to provide for higher stability of the output characteristics of radioelectronic equipment.

We claim:

1. A klystron comprising cavities with face walls in which drift tubes are accommodated in a coaxial relation to the bodies of the cavities characterized in that there are annular slots (9) in the face walls (7) and in the drift tubes (8), said annular slots accommodating plates (10) rigidly attached thereto, the height of the plates (10) being less than half the height of the body (6) of the cavity (5), the length of the plates (10) being the half-difference between the inner diameter of the cavity (6) and the inner diameter of the drift tube (8), and the length of the inner circumference of the body (6) being more than ten times the total thickness of the plates (10).

2. A klystron as claimed in claim 1, characterized in that the plates (10) are made of a nonmagnetic material.

* * * * *